US008418889B2

(12) United States Patent
Pritchett et al.

(10) Patent No.: US 8,418,889 B2
(45) Date of Patent: Apr. 16, 2013

(54) INVERTED DISPENSER PUMP WITH LIQUID INLET CUP VALVE

(75) Inventors: David John Pritchett, Ashby de la Zouch (GB); Brian Robert Law, Leicester (GB)

(73) Assignee: Rieke Corporation, Auburn, IN (US)

( * ) Notice: Subject to any disclaimer, the term of this patent is extended or adjusted under 35 U.S.C. 154(b) by 595 days.

(21) Appl. No.: 12/685,064

(22) Filed: Jan. 11, 2010

(65) Prior Publication Data

US 2011/0168740 A1 Jul. 14, 2011

(51) Int. Cl.
*B67D 7/76* (2010.01)

(52) U.S. Cl.
USPC ..... 222/190; 222/321.4; 222/321.9; 222/464.7; 222/1

(58) Field of Classification Search ..... 222/190, 222/321.4, 321.9, 464.3, 464.7, 564, 494
See application file for complete search history.

(56) References Cited

U.S. PATENT DOCUMENTS

| | | | | |
|---|---|---|---|---|
| 2,774,517 | A | 12/1956 | Teegardin et al. | |
| 3,379,136 | A | 4/1968 | Corsette | |
| 4,118,152 | A | 10/1978 | Bron | |
| 4,277,001 | A | 7/1981 | Nozawa | |
| 4,286,736 | A | 9/1981 | Corsette et al. | |
| 4,360,130 | A | 11/1982 | Nishimura et al. | |
| 4,364,718 | A | 12/1982 | Beun et al. | |
| 4,371,098 | A * | 2/1983 | Nozawa et al. | 222/321.4 |
| 4,589,573 | A | 5/1986 | Tada | |
| 4,673,109 | A | 6/1987 | Cassia | |
| 4,775,079 | A | 10/1988 | Grothoff | |
| 4,776,498 | A | 10/1988 | Maerte et al. | |
| 4,958,752 | A | 9/1990 | Maerte et al. | |
| 5,016,780 | A | 5/1991 | Moretti | |
| 5,115,980 | A | 5/1992 | SKorka | |
| 5,165,577 | A | 11/1992 | Ophardt | |
| 5,282,552 | A | 2/1994 | Ophardt | |
| 5,353,969 | A | 10/1994 | Balderrama | |
| 5,373,970 | A | 12/1994 | Ophardt | |

(Continued)

FOREIGN PATENT DOCUMENTS

| | | |
|---|---|---|
| DE | 39 29 064 A | 1/1991 |
| EP | 0 389 688 A2 | 10/1990 |

(Continued)

OTHER PUBLICATIONS

United Kingdom Patent Application 1100129.4 Search Report mailed Mar. 23, 2011.

(Continued)

*Primary Examiner* — Kevin P Shaver
*Assistant Examiner* — Patrick M Buechner
(74) *Attorney, Agent, or Firm* — Woodard, Emhardt, Moriarty, McNett & Henry LLP

(57) ABSTRACT

An inverted dispenser pump is used to dispense foam. The dispenser pump includes an air cylinder with an air piston to pump air to form the foam along with a liquid cylinder that has a liquid cylinder piston to pump liquid to form the foam. A conduit shell is received over the liquid cylinder in order to draw fluid when in an inverted state. An intake valve member is received around the opening of the conduit shell. The intake valve member has a seal flap configured to seal against the conduit shell opening in order to reduce flow restrictions of liquid drawn into the liquid cylinder.

24 Claims, 4 Drawing Sheets

U.S. PATENT DOCUMENTS

| | | | |
|---|---|---|---|
| 5,401,148 | A | 3/1995 | Foster et al. |
| 5,431,309 | A | 7/1995 | Ophardt |
| 5,445,288 | A | 8/1995 | Banks |
| 5,489,044 | A | 2/1996 | Ophardt |
| 5,676,277 | A | 10/1997 | Ophardt |
| 5,738,250 | A | 4/1998 | Gillingham et al. |
| 5,813,576 | A | 9/1998 | Iizuka et al. |
| 5,975,360 | A | 11/1999 | Ophardt |
| 5,988,456 | A | 11/1999 | Laible |
| 6,045,008 | A | 4/2000 | Gonzalez et al. |
| 6,082,586 | A | 7/2000 | Banks |
| 6,126,042 | A | 10/2000 | Meshberg |
| 6,343,724 | B1 | 2/2002 | Ophardt et al. |
| 6,409,050 | B1 | 6/2002 | Ophardt et al. |
| 6,516,976 | B2 | 2/2003 | Lewis et al. |
| 6,533,145 | B2 | 3/2003 | Lewis et al. |
| 6,540,117 | B2 | 4/2003 | Powling |
| 6,540,157 | B2 | 4/2003 | Ophardt |
| 6,543,651 | B2 | 4/2003 | Lewis et al. |
| 6,557,736 | B1 | 5/2003 | Ophardt |
| 6,575,334 | B2 | 6/2003 | Lewis et al. |
| 6,575,335 | B2 | 6/2003 | Lewis et al. |
| 6,601,736 | B2 | 8/2003 | Ophardt et al. |
| 7,004,356 | B1 | 2/2006 | Sayers |
| 7,011,237 | B1 | 3/2006 | Sayers et al. |
| 7,325,704 | B2 | 2/2008 | Kasting |
| 7,461,762 | B2 | 12/2008 | Law et al. |
| 2002/0027144 | A1 | 3/2002 | Lacout |
| 2003/0201286 | A1 | 10/2003 | Ophardt |
| 2004/0217137 | A1 | 11/2004 | Ophardt |
| 2005/0051579 | A1 | 3/2005 | Kasting |
| 2007/0215643 | A1 | 9/2007 | Law et al. |

FOREIGN PATENT DOCUMENTS

| | | | |
|---|---|---|---|
| EP | 0 703 831 81 | | 12/1998 |
| EP | 1 190 775 | A1 | 3/2002 |
| EP | 1 514 607 | A2 | 3/2005 |
| EP | 1 676 640 | A1 | 7/2006 |
| GB | 1149805 | | 4/1969 |
| JP | H08-011921 | A | 1/1996 |
| WO | WO 99/49769 | A1 | 10/1999 |

OTHER PUBLICATIONS

European Patent Application 04255318 Search Report mailed Jun. 14, 2006.

European Patent Application 05256914.2 Extended Search Report mailed Mar. 2, 2006.

Hygiene-Technik Inc., A member of the Ophardt Group of Companies, UX10 Lotion or Foam Soap Dispenser, 2004, pp. 2.

Pictures of Umbrella Valve from RD Industries of Omaha, Nebraska (Pictures 1-6), Jan. 4, 2005.

* cited by examiner

INVERTED DISPENSER PUMP WITH LIQUID INLET CUP VALVE

BACKGROUND

Inverted dispensing pumps are commonly used to dispense any number of liquids, such as liquid soap and the like. Typically, they involve some housing or mounting on which a container is mounted upside down, with a mouth of the container communicating with the intake of a dispenser pump. One issue with inverted dispensing pumps is the complete evacuation of fluid from the container. When the container is inverted, the pump is likewise inverted with its intake extending far inside the container. This causes a fluid to remain within the neck of the container, which in turn is wasted. One unique solution to tackle this container evacuation issue has been to draw the fluid with a cap received over the intake such that the opening of the cap draws fluid from closer to the neck of the container. An example of this in a unique solution has been described in U.S. Pat. No. 7,461,762, which is hereby incorporated by reference in its entirety. While this design provides a significant improvement, there are still a number of issues that need to be addressed.

For instance, the amount of fluid drawn into the pump during a given stroke can be somewhat restricted depending on the construction of the valve system. The valve needs to rapidly open and close in order to facilitate efficient pumping of the fluid, while at the same time, the valve needs to open wide enough to allow a sufficient amount of fluid to be drawn. Moreover, the valve system can be difficult to retrofit for both inverted and non-inverted pumping applications. Due to gravity, conventional valve systems, such as ball valves, may not be able to be properly seat when the pump is inverted. Umbrella valves may experience similar difficulties. Thus, there needs to be improvement in this field.

SUMMARY

Among other things, the inverted dispenser pump design described herein addresses the issue of fluid restriction by utilizing an elastomeric valve that seals at the periphery of the opening of the cup which is used to draw fluid within the cup below the neck of the container. This design also eliminates the need for an intermediate shell for an umbrella-type valve at the inlet of the pump. It also addresses the issue of valves that are adversely affected by gravity, such as ball valves. This cup-elastomeric valve design allows fluid to be drawn lower when the pump is inverted, but it also allows a simple retrofit for non-inverted dispensing pumps. In other words, this design allows for a simple retrofit for existing pumps.

DESCRIPTION OF THE SELECTED EMBODIMENTS

Figure 1:
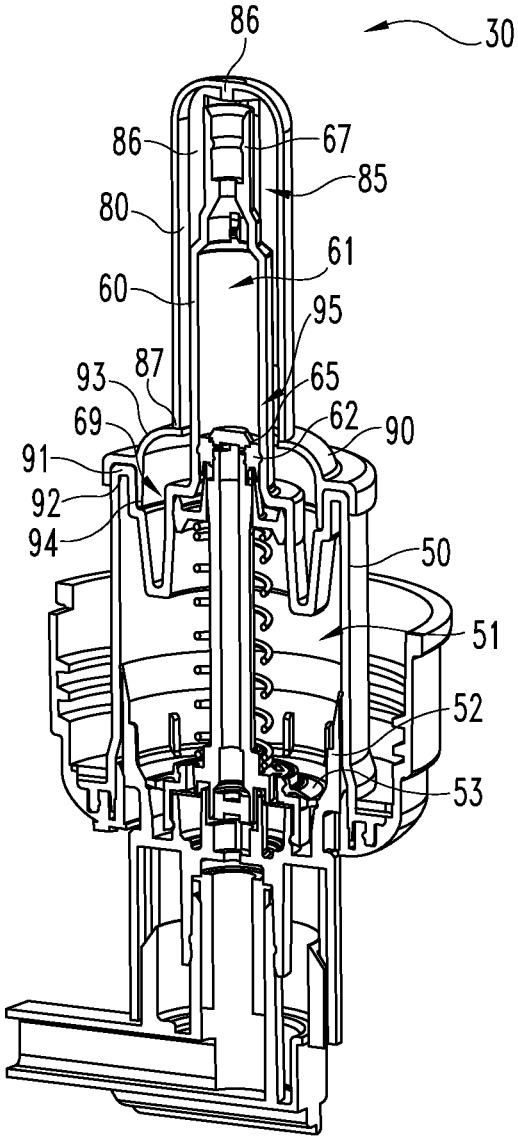
FIG. 1 is a partial cross-sectional perspective view of a dispenser pump according to one embodiment.

For the purpose of promoting an understanding of the principles of the invention, reference will now be made to the embodiments illustrated in the drawings and specific language will be used to describe the same. It is understood that the specific language and figures are not intended to limit the scope of the invention only to the illustrated embodiment. It is also understood that alterations or modifications to the invention or further application of the principles of the invention are contemplated as would occur to persons of ordinary skill in the art to which the invention relates.

Figure 2:
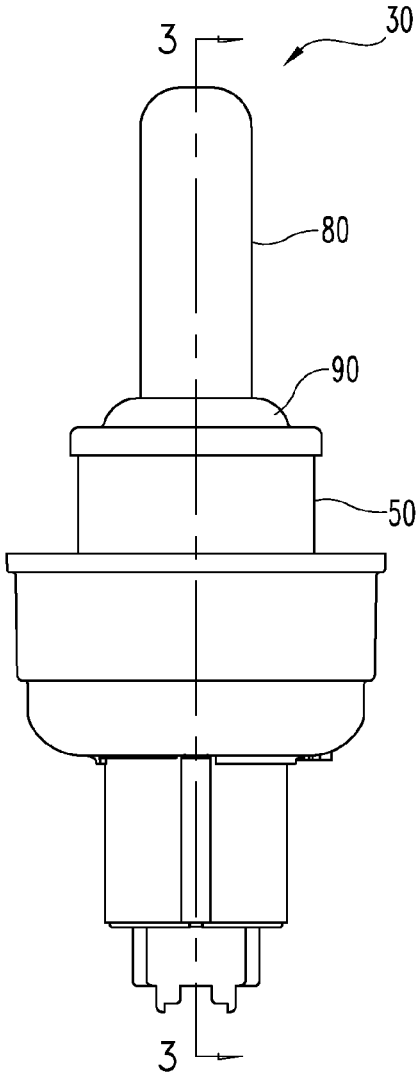
FIG. 2 is the front view of the FIG. 1 dispenser pump.
Figure 3:
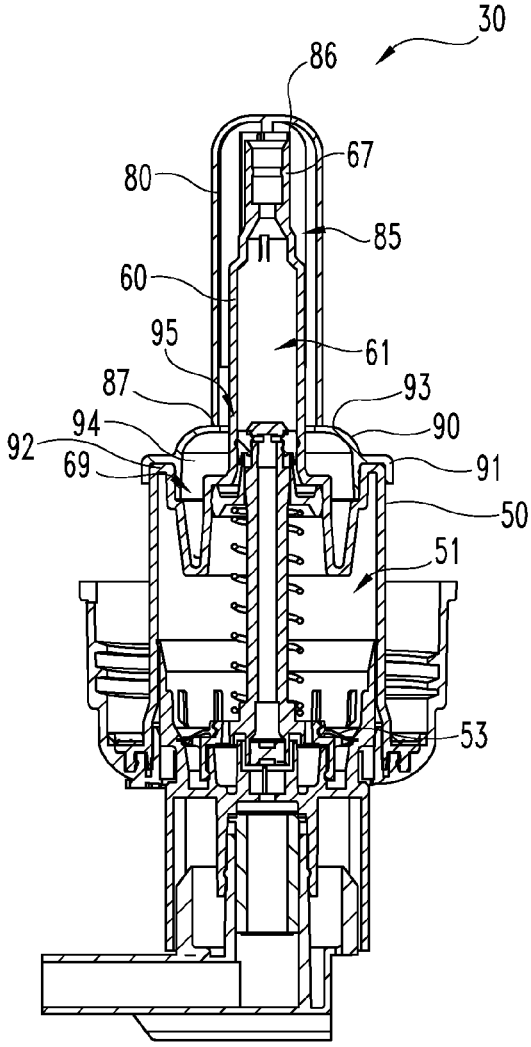
FIG. 3 is a cross-sectional view of the FIG. 2 dispenser pump as taken along line 3-3 in FIG. 2.

A dispenser pump 30 that incorporates a unique cap-valve system that enhances pumping efficiency as well as simplifies retrofitting for both inverted and non-inverted pump applications will now be described with reference to FIGS. 1, 2, and 3. FIG. 1 shows a partial cross-sectional perspective view of the dispenser pump 30. FIG. 2 shows a front view of the dispenser pump 30, and FIG. 3 shows a cross-sectional view of the dispenser pump 30 as taken along line 3-3 in FIG. 2. The dispenser pump 30 in the illustrated embodiment is a liquid foamer dispensing pump that is configured to dispense foam. As will be recognized, the dispenser pump 30 in FIG. 1 shares a number of components in common with those previously described in U.S. Pat. No. 7,461,762 to Law et al. For the sake of brevity as well as clarity, these components will not be described again in great detail, but reference is made again to U.S. Pat. No. 7,461,762 to Law et al., which is hereby incorporated by reference in its entirety. As can be seen, the dispenser pump 30 includes an air cylinder 50 with an air chamber 51 and an air piston 52 configured to pump air that forms part of the dispensed foam. The air cylinder 50 also has an air inlet valve 53 that selectively opens and closes to allow the intake of air into the air chamber 51. As can be seen, a liquid cylinder 60 extends from the air cylinder 50. The liquid cylinder 60 includes a liquid chamber 61 in which a liquid piston 62 is slidably received to pump the liquid portion of the foam. An outlet valve 65 is also disposed within the liquid cylinder 60. The liquid cylinder 60 has a spigot or connector opening 67 in which fluid is drawn into the liquid chamber 61. In the illustrated embodiment, the spigot 67 is configured to secure to a dip tube, which is used to draw fluid when in a non-inverted state. At the interface between the liquid cylinder 60 and the air cylinder 50, a trough 69 surrounds the base of the liquid cylinder 60.

Looking at FIGS. 1, 2, and 3, a conduit shell 80 is received over and around the liquid cylinder 60 to define an intake conduit or channel 85. Inside the conduit shell 80, ribs 86 space the conduit shell 80 from the liquid cylinder 60 as well as frictionally secure the conduit shell 80 to the liquid cylinder 60. It should be recognized that the conduit shell can be secured in other manners. The conduit shell 80 has a conduit opening 87 where fluid is drawn into the dispenser pump 30. As can be seen in the depicted embodiment, the conduit opening 87 is located relative to the spigot 67 closer to the trough 69. In the illustrated embodiment, the conduit opening 87 of the conduit shell 80 does not extend completely to the trough 69, but instead the conduit opening 87 is spaced slightly apart and opens above the trough 69. As will be explained below, in other variations, the conduit opening 87 of the conduit shell 80 can extend completely to the trough 69. It should be recognized that with such a construction, the conduit shell 80 is able to transport or draw in fluid into the dispenser pump at a location lower than the spigot 67 when the dispenser pump 30 is in an inverted state. Again, this enhances the evacuation of fluid from the container.

Referring to FIGS. 1 and 3, at the conduit opening, an intake valve member 90 selectively seals and unseals the conduit opening 87. This intake valve member 90 facilitates a large inflow of fluid during an uptake stroke of the pump, and at the same time quickly closes to ensure proper pumping function of the dispenser pump 30. In addition, the intake valve member 90 in conjunction with the conduit shell 80 allows for easy retrofitting of the dispenser pump 30 for inverted dispensing applications. The intake valve member 90 includes a snap groove 91 configured to secure to a rim 92 surrounding the trough 69. The intake valve member 90 further includes a seal flap 93 configured to seal against the conduit opening 87 of the conduit shell 80. A seal cavity flange 94 is received inside the trough 69 so as to assist in centering the intake valve member 90 around the trough 69. The seal flap 93 defines a seal opening 95 through which the liquid cylinder 60 extends. As noted before, the conduit shell 80 only extends partially to, but does not reach, the trough 69. The seal flap 93 in the embodiments depicted in FIGS. 1-3 bulges such that the seal flap 93 contacts and seals around the conduit opening 87. This construction facilitates the seal flap 93 deflecting to a greater extent to increase the amount of fluid that can be drawn into the conduit shell 80 during each stroke. The intake valve member 90 in one example is made from a flexible material, such as elastomeric material like rubber and/or other similar materials. As can be seen, the seal opening 95 allows fluid to communicate between the trough 69 and the intake channel 85. When the seal flap 93 is sealed against the conduit shell 80, the fluid is contained within that area.

During assembly, the intake valve member 90 is snap-fitted onto the rim 92 of the trough 69. The conduit shell 80 is then secured over the air cylinder 50. This forms a fluid path from the container to the liquid chamber 61. This dispenser pump design provides a simplified construction to form the intake valve for the dispenser pump 30.

As mentioned before, this design of the dispenser pump 30 enhances the flow of fluid into the dispenser pump 30. During an intake stroke of the dispenser pump, the seal flap 93 dislodges or disengages from the conduit shell 80 at the conduit opening 87. Fluid from the container is then drawn into the liquid cylinder 60. During a dispensing stroke, the seal flap 93 of the intake valve member 90 seats against the conduit opening 87 of the conduit shell 80, thereby sealing the liquid chamber 61 to promote pressurization of the liquid cylinder 60. The liquid from the liquid cylinder 60 is mixed with the air from the air cylinder 50 so as to form foam which is dispensed from the nozzle of the pump.

Figure 4:
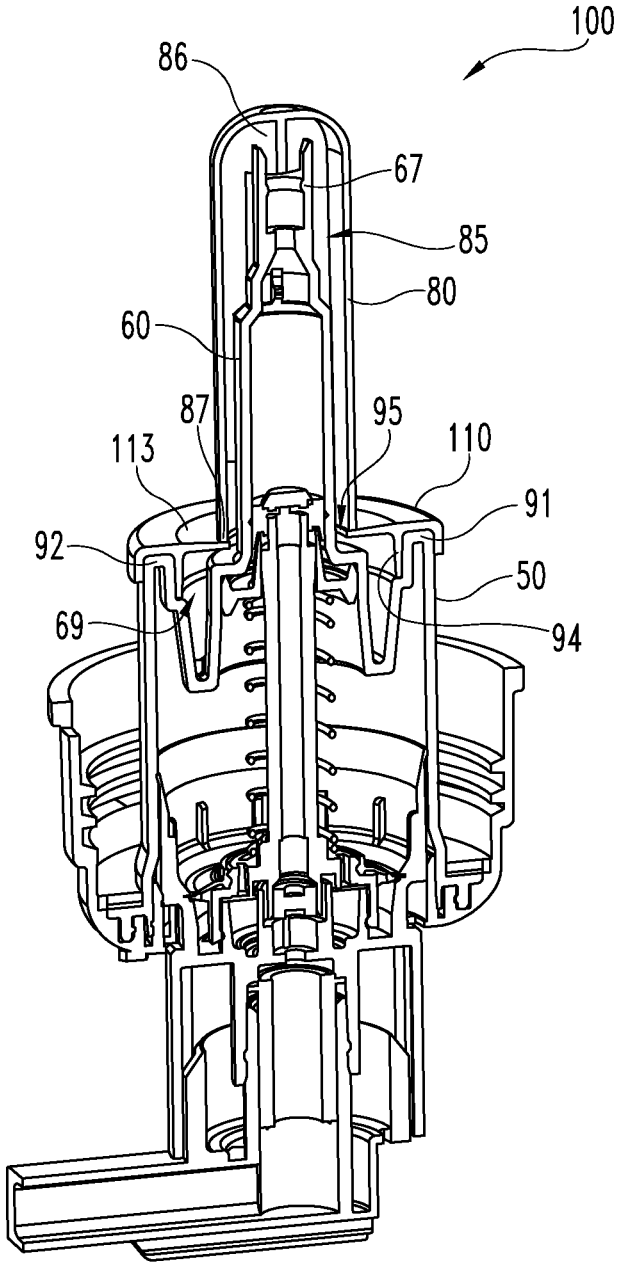
FIG. 4 is a partial cross-sectional perspective view of a dispenser pump according to another embodiment.
Figure 5:
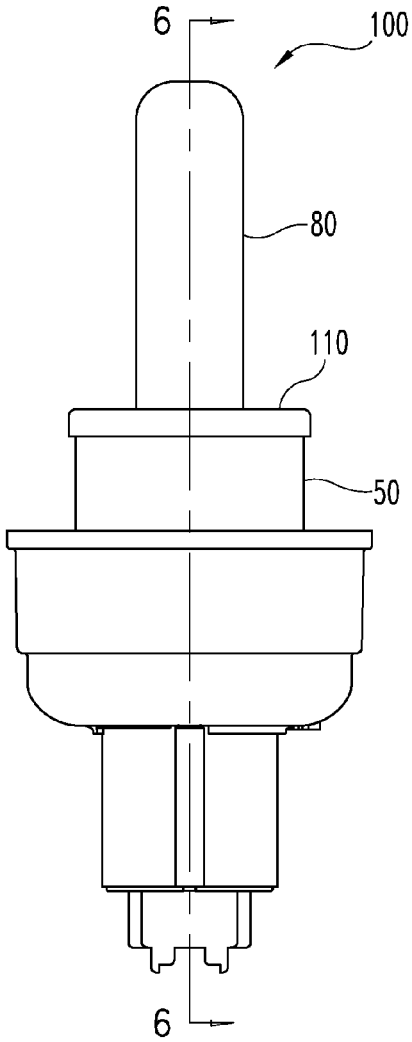
FIG. 5 is a front view of the FIG. 4 dispenser pump.
Figure 6:
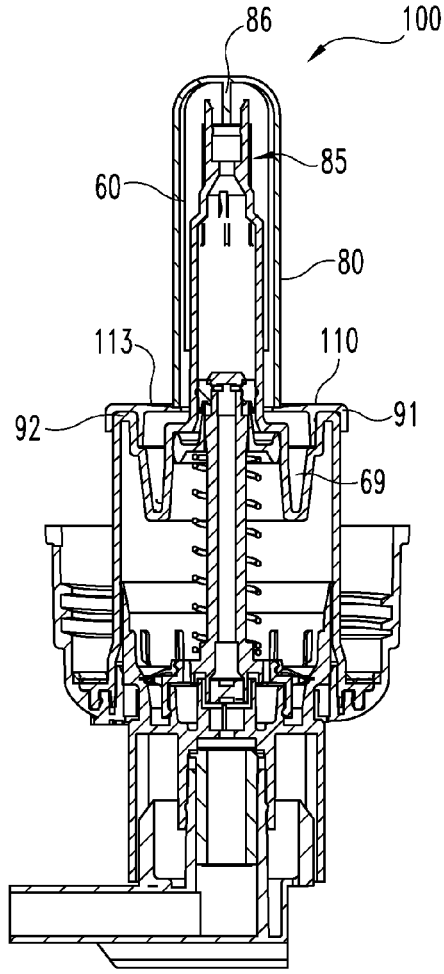
FIG. 6 is a cross-sectional view of the FIG. 5 dispenser pump as taken along line 6-6 in FIG. 5.

FIGS. 4, 5, and 6 illustrated a dispenser pump 100 in which the conduit shell 80 extends along the length of the liquid cylinder 60 all the way to the rim 92 of the trough 69. FIG. 4 shows a partial cross-sectional perspective view of the dispenser pump 100, and FIG. 5 shows a front view of the dispenser pump 100. FIG. 6 shows a cross-sectional view of the dispenser pump 100 as taken along line 6-6 in FIG. 5. As can be seen, the dispenser pump 100 in FIGS. 4-6 has a similar construction to the one previously described with reference to FIGS. 1-3. For the sake of clarity as well as brevity, these common features will not be described in detail again, but reference is made to the previous discussion of these details. Like the previous embodiment, the dispenser pump includes a conduit shell 80 received over the liquid cylinder 60. As noted before, the conduit shell 80 extends all the way to the trough 69. Similar to the previous embodiment, the dispenser pump 100 includes an intake valve member 110. Like before, the intake valve member 110 includes a snap groove 91 that engages the rim 92 of the air cylinder 50 around the trough 69. The intake valve member 110 also includes a seal centering flange 94 that centers the intake valve member 110. As can be seen, however, the intake valve member 110 has a seal flap 113 that is generally flat (i.e., not bulging). This construction allows the conduit shell 80 to draw fluid deeper within the neck of the container. Like before, the seal flap 93 defines the seal opening 95 that allows liquid to communicate between the trough 69 and the liquid cylinder 60. The conduit shell 80, like before, has ribs 86 that frictionally engage and center the conduit shell 80 around the liquid cylinder 60 so as to define intake channels 85.

The dispenser pump 100 is assembled generally in the same fashion as described above. During assembly, the intake valve member 110 is snap fitted onto the rim 92 of the trough 69. The conduit shell 80 is then secured over the air cylinder 50. This forms a flow path from the container into the liquid chamber. As should be recognized, this helps to simplify manufacturing. As should be appreciated, this provides an elegant approach for manufacturing the dispenser pump 100.

The dispenser pump 100 in FIGS. 4-6 operates in the same fashion as described above. During the intake stroke, the seal flap 113 unseats from the conduit opening 87 of the conduit shell 80 so as to allow fluid to be drawn into the intake channel 85. On the dispensing stroke, the seal flap 113 reseats against the conduit opening 87 of the conduit shell 80 so as to facilitate pressurization inside the liquid cylinder 60.

As should be recognized from the discussion above, the conduit shell 80 can be longer or shorter than is illustrated. Moreover, the specific features from dispenser pumps can be used in other types of dispenser pumps besides liquid foamer pumps. Additionally, other materials and configurations of the dispenser pumps are contemplated. For example, instead of using a snap fit connection to secure the intake valve member to the liquid cylinder, other forms of attachment can be used, such as an adhesive, welding, etc. Likewise, the conduit shell 80 can be secured to the air pump through other manners, such as through an adhesive, welding, etc.

It should be noted that any directional terms, such as "up", "down", "top", "bottom", "above", "below", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are incorporated by reference as if each individual publication, patent, or patent application were specifically and individually indicated to be incorporated by reference and set forth in its entirety herein.

The invention claimed is:

1. An apparatus, comprising:

an inverted foaming dispenser pump for dispensing foam, the inverted foaming dispenser pump including an air cylinder with an air piston to pump air to form the foam, a liquid cylinder extending from the air cylinder, the liquid cylinder having a liquid piston to pump liquid to form the foam, the liquid cylinder having an inlet opening at an end opposite the air cylinder for drawing the liquid into the liquid cylinder, a conduit shell fitted over the liquid cylinder to define an intake conduit, the conduit shell having a conduit shell opening located closer to the air cylinder than the inlet opening of the liquid cylinder for drawing the liquid to the inlet opening via the intake conduit, and an intake valve member received around the conduit shell opening, the intake valve member having a seal flap configured to seal against the conduit shell opening, the intake valve member being configured to reduce flow restrictions of the liquid drawn into the liquid cylinder, wherein the intake valve member is located outside of the conduit shell.

2. The apparatus of claim 1, further comprising:

the air cylinder having a trough with a rim around the liquid cylinder, and the intake valve member having a snap groove snap-fitted onto the rim of the trough.

3. The apparatus of claim 2, further comprising:

the conduit shell extending along the length of the liquid cylinder short of the trough where the conduit shell opening draws the liquid from outside the trough; and the seal flap of the intake valve member being rounded to extend from the rim of the trough to the conduit shell opening.

4. The apparatus of claim 2, further comprising:

the conduit shell extending along the length of the liquid cylinder to the trough where the conduit shell opening draws the liquid from the trough; and the seal flap of the intake valve member being flat.

5. The apparatus of claim 2, in which the conduit shell has one or more ribs spacing the conduit shell from the liquid cylinder to form the intake conduit.

6. The apparatus of claim 5, in which the ribs frictionally secure the conduit shell to the liquid cylinder.

7. The apparatus of claim 2, in which the intake valve member includes a seal cavity flange extending in the trough to center the intake valve member.

8. The apparatus of claim 2, in which the intake valve member includes a valve opening through which the liquid cylinder extends.

9. The apparatus of claim 1, further comprising:

the air cylinder having a trough with a rim around the liquid cylinder, the conduit shell extending along the length of the liquid cylinder short of the trough where the conduit shell opening draws the liquid from outside the trough; and the seal flap of the intake valve member being rounded to extend from the rim of the trough to the conduit shell opening.

10. The apparatus of claim 1, further comprising:

the air cylinder having a trough with a rim around the liquid cylinder, the conduit shell extending along the length of the liquid cylinder to the trough where the conduit shell opening draws the liquid from the trough; and the seal flap of the intake valve member being flat.

11. The apparatus of claim 1, in which the conduit shell has one or more ribs spacing the conduit shell from the liquid cylinder to form the intake conduit.

12. The apparatus of claim 11, in which the ribs frictionally secure the conduit shell to the liquid cylinder.

13. The apparatus of claim 1, further comprising:

the air cylinder having a trough with a rim around the liquid cylinder; and the intake valve member including a seal cavity flange extending in the trough to center the intake valve member.

14. The apparatus of claim 1, in which the intake valve member includes a valve opening in the seal flap through which the liquid cylinder extends.

15. The apparatus of claim 1, further comprising:

the conduit shell opening having a periphery; and the intake valve member sealing around the periphery of the conduit shell opening.

16. The apparatus of claim 1, further comprising:

the air cylinder having a trough with a rim around the liquid cylinder;

the intake valve member having a snap groove snap-fitted onto the rim of the trough;

the conduit shell extending along the length of the liquid cylinder short of the trough where the conduit shell opening draws the liquid from outside the trough;

the seal flap of the intake valve member being rounded to extend from the rim of the trough to the conduit shell opening;

the conduit shell having one or more ribs spacing the conduit shell from the liquid cylinder to form the intake conduit, the ribs frictionally securing the conduit shell to the liquid cylinder;

the intake valve member including a seal cavity flange extending in the trough to center the intake valve member;

the intake valve member including a valve opening through which the liquid cylinder extends;

the conduit shell opening having a periphery; and the intake valve member sealing around the periphery of the conduit shell opening.

17. The apparatus of claim 1, further comprising:

the air cylinder having a trough with a rim around the liquid cylinder;

the conduit shell extending along the length of the liquid cylinder to the trough where the conduit shell opening draws the liquid from the trough;

the seal flap of the intake valve member being flat;

the conduit shell having one or more ribs spacing the conduit shell from the liquid cylinder to form the intake conduit, the ribs frictionally securing the conduit shell to the liquid cylinder;

the intake valve member including a seal cavity flange extending in the trough to center the intake valve member;

the intake valve member including a valve opening through which the liquid cylinder extends;

the conduit shell opening having a periphery; and the intake valve member sealing around the periphery of the conduit shell opening.

18. A method of retrofitting a foaming dispenser pump for inverted operation, comprising:

providing the foaming dispenser pump that includes an air cylinder with an air piston to pump air to form foam and a liquid cylinder extending from the air cylinder, wherein the liquid cylinder has a liquid piston to pump liquid to form the foam, wherein the liquid cylinder has an inlet opening at an end opposite the air cylinder for drawing the liquid into the liquid cylinder;

attaching an intake valve member to the air cylinder with the liquid cylinder extending through a valve opening in a seal flap of the intake valve member; and securing a conduit shell around the liquid cylinder to define an intake conduit, the conduit shell having a conduit shell opening positioned to seal with the seal flap of the intake valve member, wherein intake valve member is located outside of the conduit shell during said securing.

19. The method of claim 18, further comprising:

wherein the air cylinder has a trough with a rim around the liquid cylinder, and said attaching the intake valve member including fitting a snap groove of the intake valve member onto the rim of the trough.

20. The method of claim 18, further comprising:

said securing the conduit shell including a frictionally engaging one or more ribs of the conduit shell with the liquid cylinder.

21. The method of claim 18, further comprising:

wherein the air cylinder has a trough with a rim around the liquid cylinder, and wherein the seal flap of the intake valve member is rounded to extend from the rim of the trough towards the inlet opening of the liquid cylinder; and said securing the conduit shell including positioning the conduit shell opening outside of the trough where the seal flap of the intake valve member is able to seal the conduit shell opening.

22. The method of claim 18, further comprising:

wherein the air cylinder has a trough with a rim around the liquid cylinder, and wherein the seal flap of the intake valve member is flat; and said securing the conduit shell including positioning the conduit shell opening at the trough where the seal flap is able to seal the conduit shell opening.

23. The method of claim 18, further comprising:

wherein the air cylinder has a trough with a rim around the liquid cylinder, said attaching the intake valve member including fitting a snap groove of the intake valve member onto the rim of the trough;

said securing the conduit shell including a frictionally engaging one or more ribs of the conduit shell with the liquid cylinder;

wherein the seal flap of the intake valve member is rounded to extend from the rim of the trough towards the inlet opening of the liquid cylinder; and said securing the conduit shell including positioning the conduit shell opening outside of the trough where the seal flap of the intake valve member is able to seal the conduit shell opening.

24. The method of claim 18, further comprising:

wherein the air cylinder has a trough with a rim around the liquid cylinder, said attaching the intake valve member including fitting a snap groove of the intake valve member onto the rim of the trough;

said securing the conduit shell including a frictionally engaging one or more ribs of the conduit shell with the liquid cylinder;

wherein the seal flap of the intake valve member is flat; and said securing the conduit shell including positioning the conduit shell opening at the trough where the seal flap is able to seal the conduit shell opening.

* * * * *